United States Patent [19]

Coers et al.

[11] 3,932,154

[45] Jan. 13, 1976

[54] REFRIGERANT APPARATUS AND PROCESS USING MULTICOMPONENT REFRIGERANT

[75] Inventors: Don Henry Coers, Salt Lake City, Utah; Jackie Wayne Sudduth, Clarendon Hills, Ill.

[73] Assignee: Chicago Bridge & Iron Company, Oak Brook, Ill.

[22] Filed: Jan. 17, 1975

[21] Appl. No.: 541,786

Related U.S. Application Data

[63] Continuation-in-part of Ser. No. 260,982, June 8, 1972, abandoned.

[52] U.S. Cl. ..... 62/9; 62/40; 62/54

[51] Int. Cl.[2] ..... F25J 1/00

[58] Field of Search ..... 62/9, 11, 40, 32–34, 62/36, 38, 39, 41, 42, 43, 52, 54

[56] References Cited

UNITED STATES PATENTS

| | | | |
|---|---|---|---|
| 3,364,685 | 1/1968 | Perret | 62/9 |
| 3,418,819 | 12/1968 | Grumberg | 62/40 |
| 3,592,015 | 7/1971 | Streich | 62/40 |
| 3,593,535 | 7/1971 | Gaumer et al. | 62/40 |
| 3,645,106 | 2/1972 | Gaumer et al. | 62/40 |

FOREIGN PATENTS OR APPLICATIONS

| | | | |
|---|---|---|---|
| 635,337 | 1/1962 | Canada | 62/9 |
| 1,939,114 | 2/1971 | Germany | 62/40 |

*Primary Examiner*—Norman Yudkoff
*Assistant Examiner*—Frank Sever
*Attorney, Agent, or Firm*—Merriam, Marshall, Shapiro & Klose

[57] ABSTRACT

Refrigeration is produced by compressing a multicomponent refrigerant to a high pressure, cooling the high pressure refrigerant to produce a refrigerant having a vapor phase and a liquid phase, separating the two phase refrigerant into a vapor phase and a liquid phase, passing the refrigerant vapor phase through heat exchanger means to cool and condense it to a liquid, expanding the so-formed cold stream of condensed liquid to a colder low pressure stream, passing it back through the heat exchanger means to provide low temperature refrigeration thereto to cool the high pressure vapor stream fed therethrough and have extra refrigeration for removing heat from a product, and expanding the separated high pressure liquid phase to a low pressure cool stream, feeding the low pressure cool stream to an intermediate point in the heat exchanger means, combining said stream with the cold low pressure stream formed from the vapor removed from the vessel to provide warm temperature refrigeration to remove heat from the high pressure vapor stream fed therethrough, and compressing the combined refrigerant to repeat the process, said process developing extra refrigeration for removal of heat from a product.

2 Claims, 1 Drawing Figure

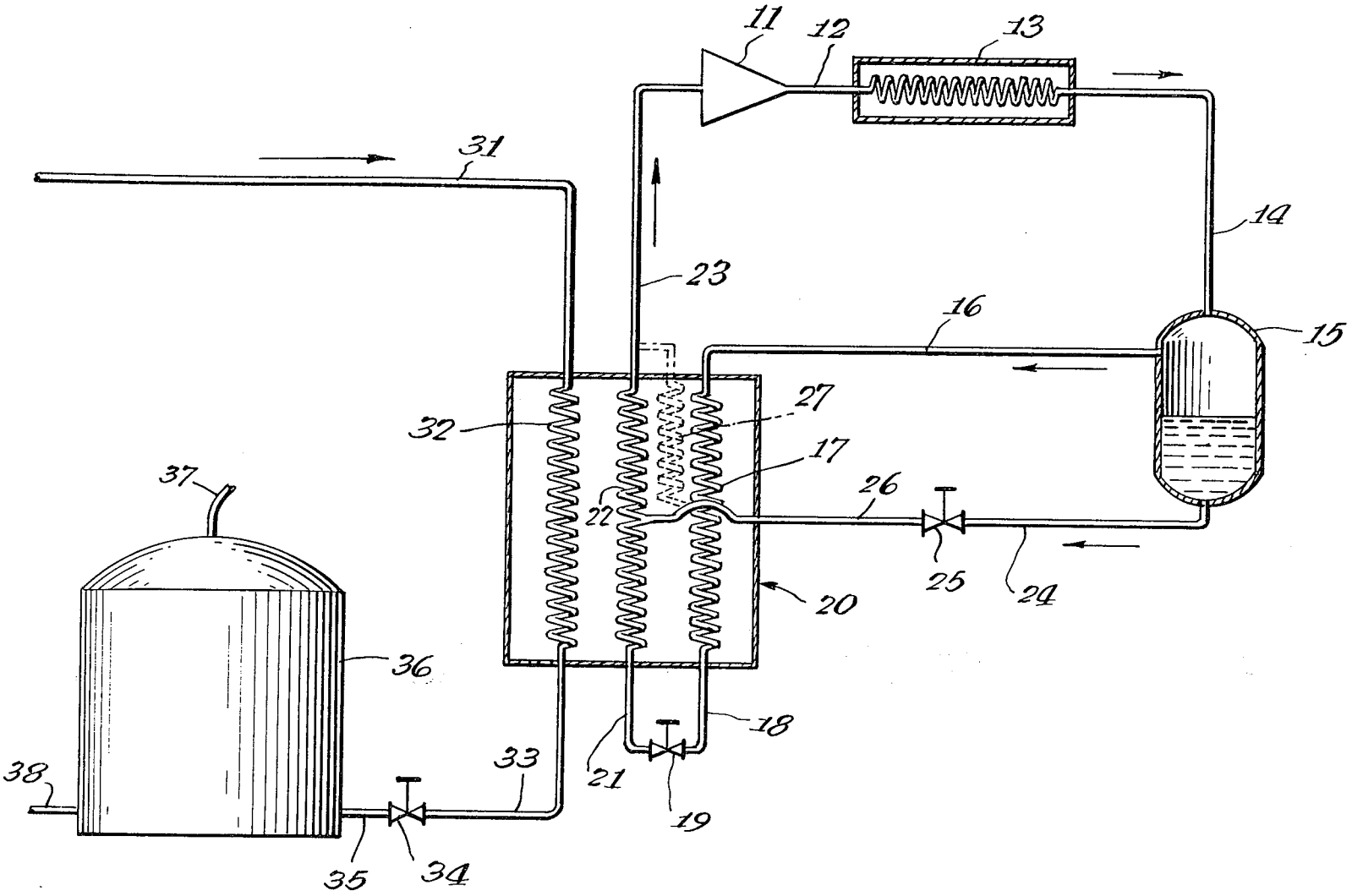
11
12
13
14
15
16
17
18
19
20
21
22
23
24
25
26
27
31
32
33
34
35
36
37
38

REFRIGERANT APPARATUS AND PROCESS USING MULTICOMPONENT REFRIGERANT

This is a continuation-in-part of our copending application Ser. No. 260,982, filed June 8, 1972, now abandoned.

This invention relates to refrigeration apparatus and processes. More particularly, this invention is concerned with a novel refrigeration process, and apparatus useful therein, for producing low temperature refrigeration adequate among other things for liquefying low boiling gases and particularly for producing cryogenic liquids.

In all mechanical refrigeration cycles, thermal energy is transferred from a region of lower temperature to a region of higher temperature by using a fluid which will evaporate and condense at suitable pressures and temperatures for practical equipment designs. The cycle is usually illustrated by a conventional pressure-enthalpy (heat content) diagram. In the simplest refrigeration cycle, a compressor is used to raise the pressure of a given refrigerant vapor sufficiently high for its saturation temperature to be above the temperature of a heat rejection medium which is usually air or water. Heat is transferred from the vapor to the heat rejection medium and causes the refrigerant vapor to condense. The refrigerant liquid is then expanded to a pressure sufficiently low for its saturation temperature to be below the temperature of the product to be cooled. The difference in temperature transfers heat from the product to the refrigerant and cause the refrigerant to evaporate. The compressor removes the refrigerant vapor, recompresses it and the cycle is repeated. A simple cycle, such as described, can be used to obtain temperatures down to about −55°F. depending on the refrigerant used and the compressor limitations.

Compound refrigeration cycles employing two or three stages of compression, with a cooler between stages, is often used to obtain colder temperatures. To obtain these lower temperatures it is common to employ a cascade cycle which employs at least two and generally three separate refrigeration cycles. A cascade cycle using only propane and ethylene will produce −150°F. In a three stage cascade cycle the refrigerants methane-ethylene-propane can be used in the separate refrigeration cycles to produce temperature to −260°F. Propane provides the first level of refrigeration to condense a second level ethylene refrigerant. The ethylene in turn provides second level refrigeration and condenses the third level methane refrigerant. Methane provides third level refrigeration, and it can be used to condense lower levels which can use nitrogen, hydrogen or helium.

The cascade cycle is quite widely used in the liquefaction of low boiling gases such as natural gas (methane), nitrogen, helium, oxygen and mixtures of these and other low boiling gases. It is used because, when operating properly, it is highly efficient and provides refrigeration with low power consumption. A cascade cycle however involves a large capital investment because of the compressors, coolers, and evaporators needed in the cycle. In addition, cascade cycles lack flexibility, and variations in the feed stream flow require adjustments in the refrigeration stages which are not easily made or controlled. Also, a small change in the flow rate of a low temperature refrigerant requires a large change in the flow rate of the warm refrigerant. Even if the refrigeration load is maintained relatively uniform, cascade cycles quite often go out of synchronization or balance with a loss in efficiency.

Another method used to produce low temperature refrigeration is by means of an expander-type cycle. Such a system requires that the gas to be used as the refrigerant be initially available as a high pressure feed stream or be brought to a high pressure. In an expander-type cycle the high pressure gas is first precooled and then expanded through a turbo-expander to produce a low temperature gaseous stream which is utilized to cool a product by counter-current heat exchange. Cycles of this type generally require ratios of expander flow to product flow of about 10 to 1 for an expander pressure ration of 6 to 1. Horsepower requirements for expander-type cycles are generally about twice the power needed for a cascade cycle and the cycles require large heat exchangers to accommodate the high mass flow rates.

Another system used to obtain low temperature refrigeration employs a multicomponent refrigerant. Systems of this type are described in Grenier U.S. Pat. No. 3,218,186; Grenier et al. U.S. Pat. No. 3,274,787; and Perret U.S. Pat. No. 3,364,685. In such systems, a multicomponent refrigerant at high pressure is partly condensed by air, water or evaporative-type heat rejection means and then directed to a vapor-liquid separation vessel from which a gaseous high pressure refrigerant stream rich in light components is removed for further processing. Successive steps of vapor-liquid separations of the refrigerant are required after liquid expansions to ultimately produce the low temperature refrigeration. In this system, the refrigerant composition is adjusted by adding components of natural gas. This may require fractionating equipment to produce the refrigerant. Depending on the number of vapor-liquid separations required, the complexity of the process approaches that of a cascade cycle. Operation of a plant using such a system is very sensitive to the composition of the liquid and vapor refrigerant streams. This requires chromatographic monitoring of the refrigerant streams because they operate with different refrigerant compositions. Also, because of the vapor-liquid separations, the flow rate of these separate phases must be regulated to control the process.

While the described system of the prior art can be used to produce low temperature refrigeration there is a clear need for a system which can be operated and controlled easier and which involves lower investment in apparatus.

According to the present invention there is provided a novel refrigeration system or cycle, and apparatus therefor, which utilizes a multicomponent normally gaseous refrigerant consisting essentially of methane (about 35–55 mole percent), ethane (about 10–30 mole percent), propane (about 10–30 mole percent) and butane (about 5–30 mole percent), the sum of the methane and ethane contents of the refrigerant being not more than about 70% and the sum of the propane and butane contents being not more than about 50%.

The refrigerant is compressed to a suitable high pressure by a compressor means and thereafter heat is rejected to a suitable heat sink, such as air or water. At least partial condensation of the refrigerant occurs at this point. The partially condensed high pressure refrigerant stream is then fed to a separator vessel in which the refrigerant vapor phase is separated from the liquid phase. The high pressure vapor is removed from the separator and passed to a heat exchanger where it is cooled and condensed. The now cooled high pressure stream is removed from the heat exchanger and expanded to a low pressure stream, further reducing its temperature, and it is passed through the heat exchanger countercurrent to flow of the high pressure refrigerant vapor to provide cold refrigeration to cool the refrigerant vapor and have extra refrigeration for removing heat from a product stream which can be passed through the heat exchanger. The low pressure refrigerant stream leaving the heat exchanger is then sent to the compressor means.

Liquid phase refrigerant is withdrawn from the separator vessel, expanded to a low pressure and fed to the heat exchanger at an intermediate point to provide additional refrigeration to cool the vapor stream from the separator vessel and incoming product. This low pressure stream is advisably injected into the low pressure refrigerant stream formed from the refrigerant vapor removed from the separator vessel, after the latter has passed at least partially through the heat exchanger. The resulting combined stream provides refrigeration to the warm temperature end of the head exchanger to cool incoming vapor from the separator vessel and incoming product. Alternatively, these streams can be kept separate in their passage through the heat exchanger. In either case, however, the streams are combined to form a single refrigerant stream before being returned to the suction side of the compressor means.

The refrigeration produced as described can be used for any purpose desired, e.g., partial or total liquifaction of a low boiling gas product, such as natural gas.

The invention also provides a refrigeration system or refrigeration apparatus. It includes a compressor, a high pressure refrigerant conduit from the compressor to a heat rejector, a high pressure refrigerant conduit from the heat rejector to a refrigerant separator vessel for separating the refrigerant into a liquid phase and a vapor phase, a high pressure refrigerant vapor conduit from the separator vessel to a heat exchanger for passage of the vapor therethrough to cool the same, a high pressure refrigerant liquid conduit from the heat exchanger to an expansion valve for delivery of cooled high pressure refrigerant from the heat exchanger to the expansion valve, a cold low pressure refrigerant conduit from the expansion valve to the same said heat exchanger for delivery of cold low pressure refrigerant vapor to the heat exchanger to supply refrigeration thereto, a low pressure refrigerant conduit from the heat exchanger to the compressor for delivery of the low pressure refrigerant from the heat exchanger to the compressor, a high pressure refrigerant liquid conduit from the separator vessel to a second expansion valve for delivery of high pressure refrigerant liquid from the separator vessel to the second expansion valve, a cool low pressure refrigerant conduit from the second expansion valve to an intermediate point in the heat exchanger for delivering cool refrigerant which is part liquid and part vapor, formed from the refrigerant liquid, from the second expansion valve to the heat exchanger for providing refrigeration thereto, and means delivering said vapor to the compressor, and a multicomponent mixed gas refrigerant in said system.

The described refrigeration system or apparatus can be used in a refrigeration plant, such as for liquefying gases. A gas product feed stream conduit extending from a source for said gas product to the heat exchanger can convey a warm gas product to the heat exchanger for passage therethrough. A conduit extending from the heat exchanger to a gas product expansion valve can be used to deliver partially or fully condensed gas product from the heat exchanger to the valve and a conduit from the gas product expansion valve to a tank can convey cooled gas product to storage. The refrigeration supplied by the apparatus can be used to liquefy many gases, including nitrogen, natural gas, ethane, oxygen and hydrogen.

The refrigeration process and system of this invention uses a multicomponent refrigerant effectively and presents no problems with heavy hydrocarbon liquids at compressor suction. The refrigeration cycle is very easily controlled with separation of the liquid phase. The refrigerant amount in each phase will readily and automatically adjust itself to the right proportion for load and ambient changes.

Because of the efficiency of the refrigeration cycle, lower horsepower is needed, and a smaller heat exchanger can be used, than in many other refrigeration cycles to obtain an equal quantity of refrigeration. By permitting use of a smaller heat exchanger, it is possible in some installations to use only one heat exchanger for the complete refrigeration system. Also, the cycle lends itself to use with a centrifugal compressor as the compressor means in the cycle. Furthermore, instead of using water as the refrigerant cooler, ambient air can be used with only a small increase in horsepower.

A refrigeration plant can be built utilizing the described system which will have fewer pieces of equipment and lower capital costs. Because there is less equipment, less interconnecting piping is needed. The heat exchanger can be of relatively simple construction, usually not requiring a cold box. The system is also easy to control and operate since it employs only one multicomponent refrigerant and the phases are separated but once. The prior art processes require control of the refrigerant with each separation of the refrigerant into phases. Such multiple control is avoided by the system of this invention. Adjustment in the system of this invention is effected by the changing of the refrigerant composition or by changing of the refrigerant composition or by changing the compressor suction and/or discharge pressure.

The specific conditions to be employed in any refrigeration plant which utilized this invention will depend initially on the product composition and pressure. The refrigeration system must then be engineered to produce temperatures cold enough to permit the feed gas, at an intial temperature and pressure, to be cooled and condensed. The product gas fed to the system may have to be pressurized before it is cooled. While there is thus a careful balance of conditions needed to produce low temperature product feed, this is well understood and known by those skilled in the art. The main problem has been to supply the quantity of refrigeration at a proper temperature level required by the product gas undergoing refrigeration.

In designing a refrigeration plant employing this invention, the enthalpy vs. temperature curves for a mixed refrigerant, with pressure as a parameter, are observed for the high pressure and low pressure portions under consideration for use in the process. The quantity of refrigeration available at any temperature level between the two pressure curves can be read from the graph. By observing such plots, a set of pressures and a refrigerant mixture is picked which will yield the required quantity of refrigeration.

The invention will now be described further in conjunction with the accompaying drawing which is a schematic illustration of a novel combination of apparatus used in practicing the refrigeration process.

With reference to the drawing, a refrigerant comprising a gaseous mixture consisting essentially of methane, ehtane, propane and butane, is compressed by compressor 11 to a high pressure in the range of about 300 psig to 650 psig at about 200° to 400°F. A centrifugal compressor usually can be used for this purpose. The warm high pressure refrigerant is fed from compressor 11 by conduit 12 to heat rejector 13 which removes heat from the high pressure refrigerant and lowers it to about 50°F to 120°F and usually to just about ambient temperature. Air and/or water is advisably used as the heat sink to absorb heat from the refrigerant as it passes through heat rejector 13. The composition of the refrigerant is selected so that about 10 to 40 mole percent of the refrigerant is condensed by passage through the heat rejector thereby forming a refrigerant liquid phase and a refrigerant vapor phase. The refrigerant exiting from heat rejector 13 to conduit 14 can be at a temperature of about 50° to 120°F, and a pressure of about 300 psig to 650 psig.

The refrigerant is fed by conduit 14 to separator vessel 15 where refrigerant liquid and refrigerant vapor are separated. Refrigerant vapor is removed from vessel 15 by conduit 16 and fed through heat exchange tube 17, in heat exchanger 20, to conduit 18. The cold high pressure refrigerant vapor is fed by conduit 18 at about 300 to 650 psig and −300°F to −100°F to expansion valve 19 through which the vapor is isenthalpically expanded to conduit 21 which feeds the colder low pressure vapor at about 15 to 100 psig and −300°F to −100°F to heat exchange tube 22 in heat exchanger 20. Low temperature refrigeration is provided by the cold refrigerant as it boils and passes through tube 22. As the low pressure vapor passes through tube 22 it is warmed and is mixed with refrigerant from conduit 26, and is fed to conduit 23 which returns it to compressor 11 for recycling.

The refrigerant liquid phase is withdrawn from separator vessel 15 by conduit 24 simultaneously with withdrawal of vapor therefrom by conduit 16. The high pressure refrigerant liquid phase is fed by conduit 24 to expansion valve 25 and expanded isenthalpically through it to conduit 26 to form cool low pressure refrigerant advisably at about 15 to 100 psig and −50°F to 50°F. The cool low pressure refrigerant which is part vapor and part liquid is advisably fed by conduit 26 to heat exchange tube 22 intermediate its length so that the two low pressure vapor streams fed by conduits 21 and 26 can be combined and the refrigeration of each utilized. It is however within the purview of the invention to feed the low pressure vapor from conduit 26 into a separate heat exchange tube, such as tube 27 shown in dotted lines, at an intermediate point in the length of heat exchanger 20 and to thereafter feed the stream to conduit 23. The combined refrigerant stream is advisably fed by conduit 23 at 15 to 100 psig and 40° to 110°F to the suction side of compressor 11.

The cold low pressure refrigerant passing through tube 22 in heat exchanger 20 cools the high pressure refrigerant vapor fed countercurrent thereto through tube 17 and provides extra refrigeration which can be used to cool a product.

The refrigeration system as described can be used to cool a product gas feed stream to a suitable temperature which will result in partial or total condensation of the product gas feed. A gas feed stream, advisably under substantial pressure, can be fed by conduit 31 to heat exchanger 20 for passage therethrough by heat exchange tube 32. The gas feed stream is advisably passed through the heat exchanger countercurrent to flow of the low pressure-low temperature refrigerant which flows through tube 22. The cooled product feed stream, which may be partially or all condensed, is fed from heat exchanger 20 by tube 32 to conduit 33, which communicates with expansion valve 34. The feed stream is expanded through vavle 34 to a low pressure and by conduit 35 it is fed to storage tank 36. If the cooled feed stream is warmer than the storage temperature, then a portion of the feed stream will flash to vapor upon expansion. Flash and boil-off vapors are removed from storage tank 36 by conduit 37 from which it can be returned to conduit 31 or a distribution line. Liquefied gas can be removed from tank 36 by conduit 38.

The arrangement described above permits the attainment of the lowest possible temperatures with a refrigerant of a given composition operating over a fixed pressure range. The lower temperatures are achieved because the low pressure refrigerant is used to further subcool the high pressure refrigerant before throttling. The process also takes full advantage of the multicomponent refrigerant to minimize the temperature differences between the product being cooled and the refrigerant stream, thus improving the efficiency of the process.

The following example is presented to further illustrate the invention.

EXAMPLE

A refrigerant mixture consisting of 37 mole percent methane, 21 mole percent ethane, 18.5 mole percent propane and 23.5 mole percent butane (including small concentrations of heavier hydrocarbons) is used in the refrigeration cycle shown in the drawing to liquefy a feed stream of natural gas.

The refrigerant is fed by line 12 at 25 psig and 105°F to compressor 11. The refrigerant is fed by conduit 12 at 450 psig and 370°F to heat rejector 13. Heat is there rejected to the air and the refrigerant temperature is lowered to about 114°F. The refrigerant is then fed by conduit 14 at 445 psig and 114°F to separator vessel 15. Refrigerant vapor (46.34 mole percent methane, 23.23 mole percent ethane, 16.42 mole percent propane and 14.01 mole percent butane and heavier hydrocarbons) is removed from vessel 15 by conduit 16 and sent through heat exchange tube 17 from which it passes to conduit 18 at 435 psig and −205°F. After being expanded through valve 19, the low pressure cold refrigerant is fed by conduit 21 at 30 psig and −208°F to heat exchange tube 22.

The liquid phase refrigerant (8.36 mole percent methane, 13.62 mole percent ethane, 25.2 mole percent propane and 58.82 mole percent butane and higher hydrocarbons) in vessel 15 is conveyed by conduit 24 at 444 psig and 114°F to expansion valve 25 from which it is fed to conduit 26 at 28 psig and 28°F which delivers it to heat exchange tube 22 intermediate its length to provide refrigeration therein.

The recombined refrigerant stream is fed from heat exchange tube 22 to conduit 23 at 25 psig and 105°F and is thereby recycled to compressor 11.

A feed or product stream of natural gas at 75°F and 578 psig is delivered by conduit 31 to heat exchange tube 32 in heat exchanger 20. The feed stream emerges from the heat exchanger at −205°F and 569 psig and by means of conduit 33 it is fed to expansion valve 34. The feed stream emerges from the expansion valve and is fed by conduit 35 to insulated storage tank 36. The liquefied natural gas is stored at about −256°F and 1.7 psig in tank 36 and the vapor phase from the flash expansion is removed by conduit 37 and fed to a service line and/or alternatively compressed such that it can be fed to conduit 31. Conduit 38 is used to remove liquefied natural gas from tank 36 as needed.

The flow rates through the apparatus in this example are as follows:

| Apparatus identifying number in the drawing | Million standard cubic feet per day |
|---|---|
| 12 & 14 | 15.5 |
| 16, 18 & 21 | 11.67 |
| 24 & 26 | 3.83 |
| 23 | 15.5 |
| 31 | 6.73 |
| 33 | 6.67 |
| 36 | 5 |
| 37 | 1.67 |

Various changes and modifications of the invention can be made and, to the extent that such variations incorporate the spirit of this invention, they are intended to be included within the scope of the appended claims.

What is claimed is:

1. A refrigeration process consisting essentially of:

compressing a normally gaseous multicomponent refrigerant to an elevated pressure by compressor means, said refrigerant consisting essentially of about 35–55 mole percent methane, about 10–30 mole percent ethane, about 10–30 mole percent propane, and about 5–30 mole percent butane, the sum of the methane and ethane concentrations being not more than about 70 percent, and the sum of the propane and butane concentrations being not more than about 50 percent, cooling the high pressure refrigerant to a temperature of about 50°F to 120°F by heat rejection to the ambient to produce a refrigerant having a vapor phase and a liquid phase consisting of about 10 to 40 mole percent of the refrigerant, directly passing the two phase refrigerant to a phase separating vessel without further cooling, withdrawing the vapor phase as a high pressure stream from the vessel and passing said high pressure stream through a heat exchanger to cool and condense said high pressure stream to a liquid, removing the liquefied high pressure stream of condensed liquid from the heat exchanger, expanding said liquefied high pressure stream to produce a cold low pressure stream, passing said cold low pressure stream through the heat exchanger to provide low temperature refrigeration to cool the high pressure vapor stream fed through said heat exchanger and provide extra refrigeration for removing heat from a gas product, and then feeding the cold low pressure stream to the compressor means, withdrawing the liquid phase from said vessel, expanding said liquid phase to a low pressure without cooling prior to expansion, feeding the resultant low pressure cool stream to an intermediate point in the heat exchanger, passing said resultant low pressure cool stream through the heat exchanger in the same direction as the stream formed from vapor removed from said vessel, combining said low pressure cool stream and said vapor stream from said vessel to form a single stream at a pressure below about 100 psig, and returning the combined stream to the inlet of said compressor; and passing a gas product feed stream under pressure through the heat exchanger to cool the gas product feed stream by heat exchange with the refrigerant passed through said heat exchanger, to a temperature which can provide at least partial liquefaction of the gas product feed stream.

2. A refrigeration process according to claim 1, in which the high pressure cooled refrigerant passed to the phase separating vessel is at a pressure of about 300 psig to 650 psig, and the low pressure refrigerant fed to the suction side of the compressor means is at a temperature of about 40° to 110°F.

* * * * *